US006968781B1

(12) United States Patent
Petersen

(10) Patent No.: US 6,968,781 B1
(45) Date of Patent: Nov. 29, 2005

(54) INK CARTRIDGE FOR HAND STAMP

(76) Inventor: Craig J. Petersen, 410 Meacham, Park Ridge, IL (US) 60068

( * ) Notice: Subject to any disclaimer, the term of this patent is extended or adjusted under 35 U.S.C. 154(b) by 0 days.

(21) Appl. No.: 11/036,516

(22) Filed: Jan. 13, 2005

(51) Int. Cl.[7] ..... B41K 1/50
(52) U.S. Cl. ..... 101/333; 101/327
(58) Field of Search ..... 101/103, 327, 101/333, 405, 406, 368; B41K 1/50

(56) References Cited

U.S. PATENT DOCUMENTS 3,832,947 A * 9/1974 Funahashi ..... 101/327
5,577,444 A * 11/1996 Toyama ..... 101/379
5,858,298 A * 1/1999 Humal ..... 264/413
5,942,312 A * 8/1999 Venkataraman et al. . 428/195.1
5,996,493 A * 12/1999 Okumura et al. ..... 101/333
6,047,639 A * 4/2000 Shih ..... 101/333
6,164,202 A * 12/2000 Takami ..... 101/405
6,834,584 B1 * 12/2004 MacNeil ..... 101/333

* cited by examiner

*Primary Examiner*—Leslie J. Evanisko
(74) *Attorney, Agent, or Firm*—Knechtel, Demeur & Samlan

(57) ABSTRACT

An ink cartridge or inkpad for use in a hand stamp in which the cartridge is made up of two parts. There is a frame portion and a central removed portion or well. Ink is deposited into the well and absorbed by the foam stamping member and the frame portion. In a first embodiment the central removed portion is reinserted back into the cartridge to provide additional ink storage medium and to impart structural strength to the stamping member. A trim ring supports the stamping member and locks the stamping member and ink cartridge into the stamp mount. This minimizes the mess associates with inking inkpads and also minimizes ink loss due to evaporation and drying. It also reduces the inventory of ink cartridges required by a stamp manufacturer as the cartridges are stored dry and the desired color ink is only placed in the ink cartridge when the stamp is manufactured for the user.

20 Claims, 6 Drawing Sheets

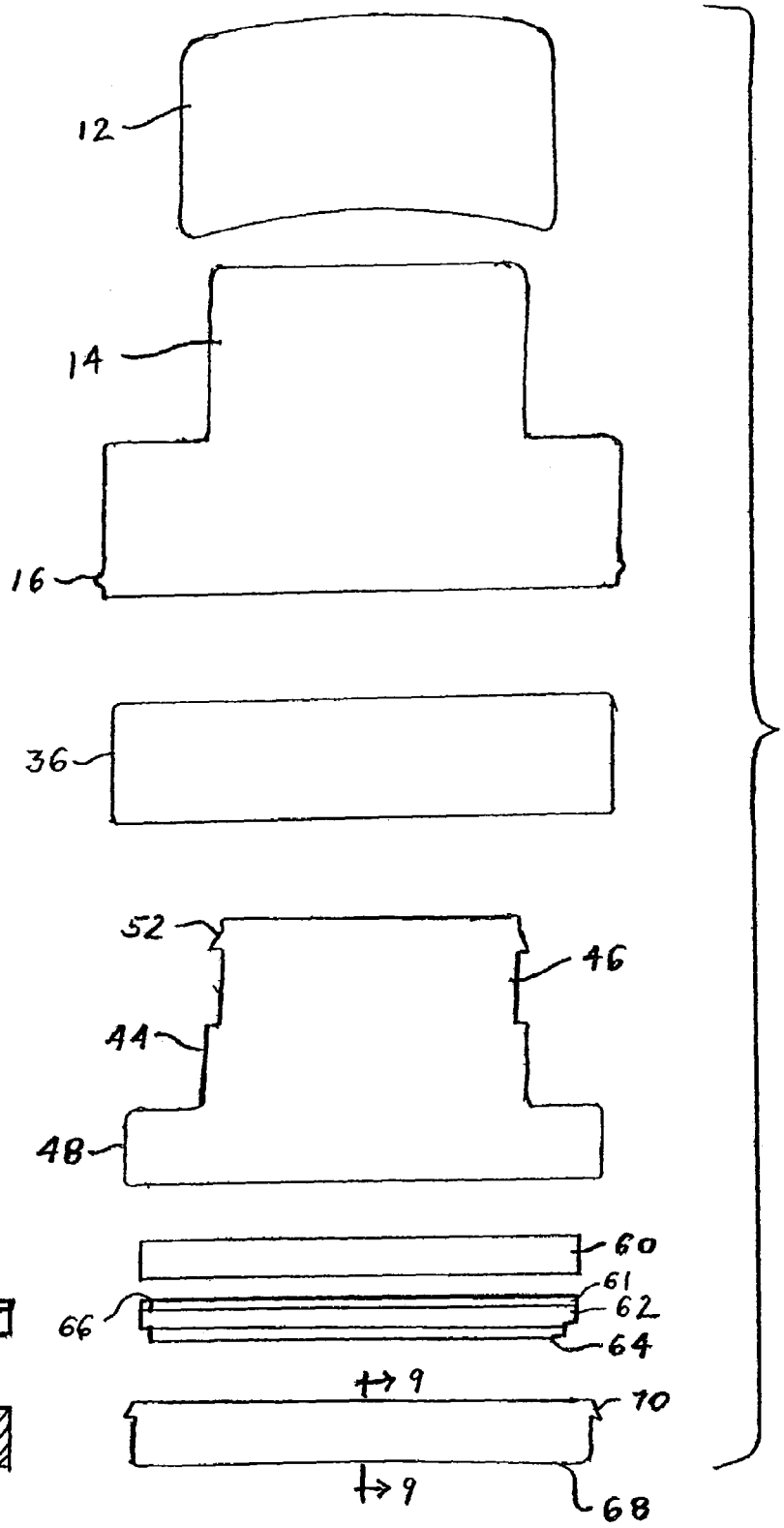
FIG. 2
FIG. 8
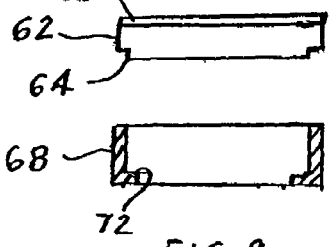
FIG. 9

INK CARTRIDGE FOR HAND STAMP

BACKGROUND AND SUMMARY OF THE INVENTION

This invention relates to hand stamps and more particularly to a hand stamp that is received by the user as a self-contained pre-inked hand stamp that does not require the use of a separate stamp inkpad.

Most conventional stamps require manufacturing a stamping member from rubber or other flexible material. The stamping member is mounted on a handle that is grasped by the user. The stamping member is placed into contact with ink, usually contained in an inkpad. The inked stamping member is then pressed against the surface onto which the stamp image is to be transferred. Repetition of the stamping process required that the stamping member be pressed against the inkpad each time an image is to be transferred. This is a disadvantage to the user as it requires extra time for each re-inking step and slows down the stamping process if many stampings are to be done. It also requires the use of a separate inkpad that must be periodically re-inked.

An improved stamp was developed. This used a stamping member made from a permeable foam material that allowed ink to pass through the stamping member. The ink was held within the stamp and allowed to gradually ooze onto the stamping member. This eliminated the need for a separate stamp inkpad.

This type of stamp pad is illustrated in U.S. Pat. No. 5,942,312 issued to Venkataraman et al. This patent discloses a pre-inked thermoplastic foam which has open cells in the area that is designed to transfer ink and closed or sealed cells in the area which is designed to be impermeable to ink. The inkpad is pre-inked before the image is formed on the thermoplastic material. Thus if there is a problem with the image, the entire pad including the ink, is wasted. Furthermore there may be difficulties in forming an image on a pre-inked pad as it may be messy or require special handling due to the ink in the pad.

Hand stamp users preferred the ease and convenience of the pre-inked stamps. A separate inkpad with its inherent mess was no longer required. The stamp manufacturers now had the problem of creating the image on the foam stamp surface and pre-inking the stamp so that it was ready for use by the user. An improvement to creating the image on the stamp foam surface is illustrated in U.S. Pat. No. 5,858,298 issued to Leo Humal. This patent discloses a method to make the image on the surface of a porous thermoplastic material by heat sealing portions of the surface to define the image. In order to use the thermoplastic stamp surface, it is necessary to provide an ink cartridge with a supply of ink against the porous thermoplastic stamp material. One approach to pre-inking the stamp was to use a pre-inked cartridge. The pre-inked cartridge was shipped to the stamp manufacturer in a sealed airtight bag. The stamp manufacturer would cut the bag, carefully remove the pre-inked cartridge, place it in contact with the porous thermoplastic stamp surface, and allow the ink from the cartridge to migrate through the porous stamp surface. This generally took up to one hour for the ink migration to occur so that the stamp could be used. Thus the process was time consuming. The process was also still messy in that the cartridge had to be carefully removed, usually using tweezers or gloves.

Yet another problem was the large inventory of pre-inked cartridges required to be carried by the stamp manufacturer. A different size cartridge is required for each stamp size. In addition, each color offered must be stocked for all of the stamp sizes. This resulted in a large number of pre-inked cartridges being held in inventory.

Applicant's invention addresses and solves the problems of the prior art devices. It also has several advantages over the prior devices. The invention comprises a new and improved ink cartridge that is received into the hand stamp. The ink cartridge and foam stamping member are mounted in the hand stamp by means of a trim ring. The foam stamping member is made of a porous foam material. There are ink impermeable portions and open portions on the foam stamping member that define an image. A non-inked (dry) ink cartridge having a center portion removed is provided. The ink cartridge is placed on the backside of the foam stamping member in the trim ring. The proper color ink is then poured into the removed center portion of the ink cartridge. The ink migrates into the foam stamping member and the ink cartridge. The center portion that was removed from the ink cartridge is reinserted. The trim ring is then inserted into the hand stamp which is ready for printing. In an alternate arrangement, the foam stamping member is provided with a second layer of ink absorbing foam material that rapidly absorbs ink when it is poured into the removed center portion of the ink cartridge.

OBJECTS AND ADVANTAGES

Thus it is an object of the present invention to provide an ink cartridge for a hand stamp with a recess area that allows the stamp manufacturer to pour the ink into a recess. This allows a predetermined quantity of ink to be dispensed into the ink cartridge.

Another object is to provide an ink cartridge that has a center removed portion that is removed for depositing the ink onto the ink cartridge and reinserted after the ink has been absorbed into the ink cartridge and foam stamping member.

An advantage of the ink cartridge is that it allows the stamp manufacturer to inventory fewer ink cartridges as a separate ink cartridge is no longer required for each color stamp. The reason is that the desired color ink is poured into the ink cartridge just prior to use.

Yet another object is to provide a foam stamping member having a porous layer attached to the foam stamping member to increase the rate of flow of ink into the stamp member and thereby decrease the time it takes to complete assembly of the finished hand stamp. A related advantage of this increased flow rate is it allows the use of a porous ink cartridge having its center portion removed.

These and other objects and advantages will be apparent from reviewing the following Description of the Drawings and Description of the Preferred Embodiment.

DESCRIPTION OF THE DRAWINGS

FIG. 2 is a front exploded view of the hand stamp with the inventive ink cartridge.

FIG. 8 is an end view of the stamping member.

FIG. 9 is a cross section view of the trim ring taken along line 9—9 of FIG. 2.

DESCRIPTION OF THE PREFERRED EMBODIMENT

Figure 1:
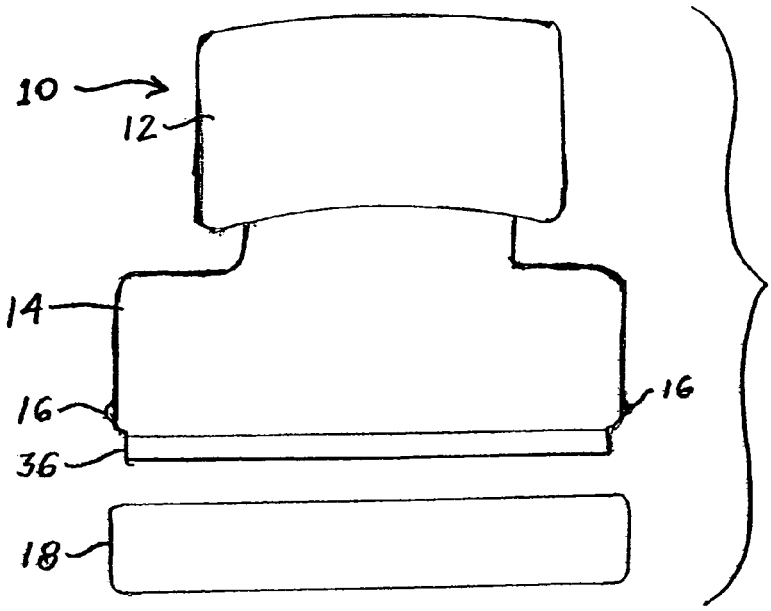
FIG. 1 is a front elevation view of the assembled stamp separated from the bottom cover.
Figure 5:
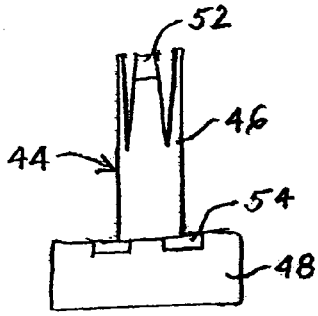
FIG. 5 is an end view of the stamp mount.

Turning to FIG. 1 there is illustrated a hand stamp 10 having the inventive ink cartridge of the present invention. The stamp 10 is commonly referred to a self inking hand stamp as it does not require the use of a separate inkpad that is not a part of the hand stamp 10. Although the disclosure describes one type of self inking hand stamp, other types of self inking hand stamps are also available, although all operate similarly. There is a handle cover 12 designed to be grasped by the user. The handle cover 12 is mounted over a stamp frame 14. A pair of nubs or protrusions 16 on the stamp frame 14 engages receiving holes in a bottom cover 18 to snugly retain the stamp frame 14 in the cover 18 when it is to be stored.

Figure 3:
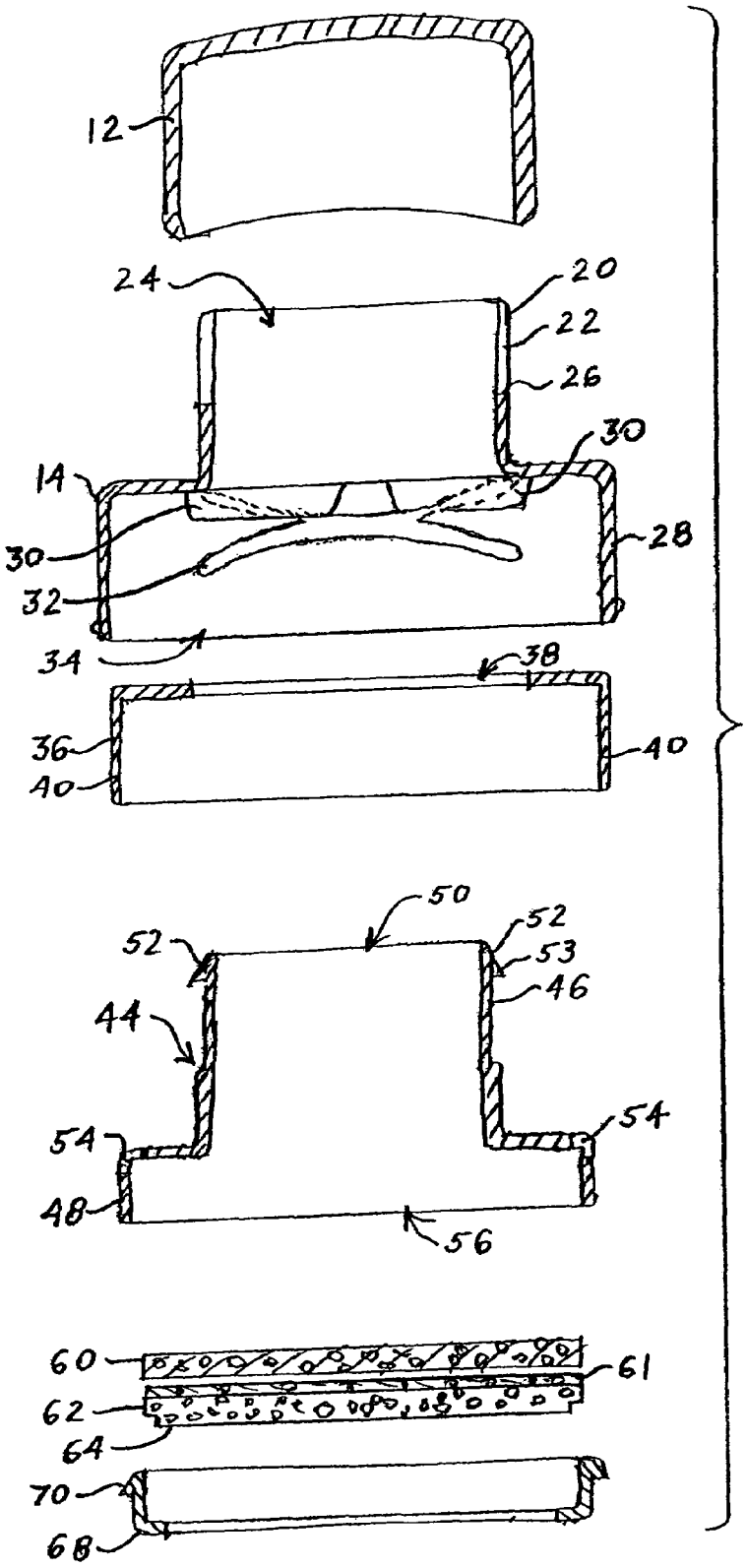
FIG. 3 is a front exploded view in cross section of the hand stamp with the inventive ink cartridge.
Figure 4:
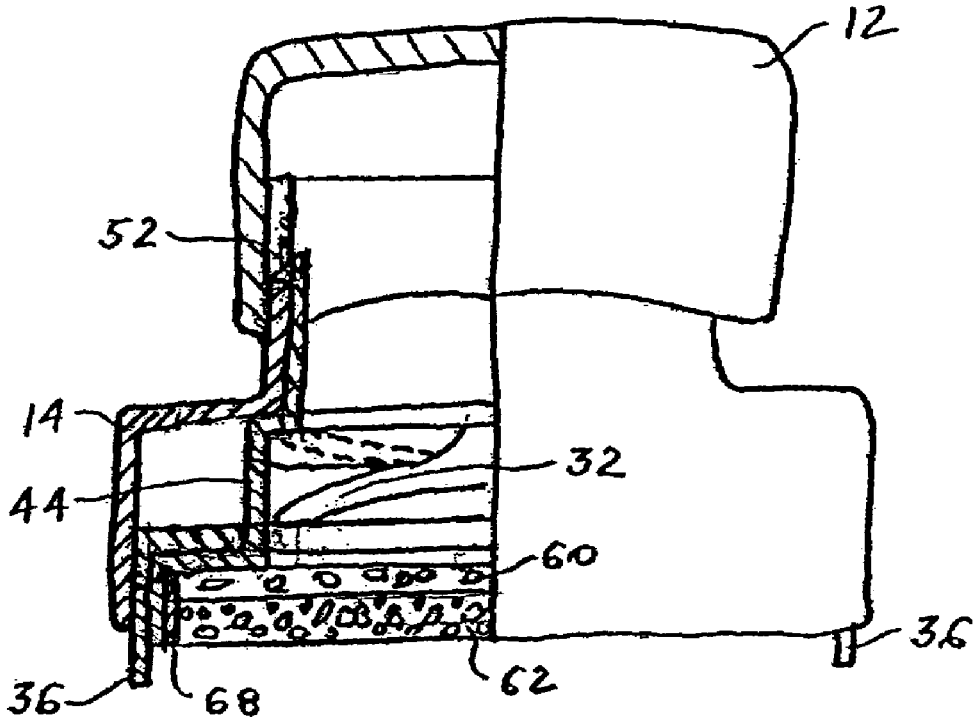
FIG. 4 is a front view of the assembled stamp partially in cross section to illustrate the orientation of parts and means for fastening the entire stamp together.

FIGS. 2 and 3 clearly illustrate the various parts and assembly of the stamp. The stamp frame 14 has a handle at an upper portion 22 with a central passageway 24. The handle cover 12 is adapted to be slipped over the handle 20 to cover the central passageway 24. A portion of the upper portion 22 is cut out to form a shoulder 26. The handle has a lower portion 28 that has a pair of retainer plates 30 along each of its longest sidewalls. The retainer plates 30 hold two arms of a double wishbone spring member 32. The other two arms of the wishbone spring member extend downward toward a bottom opening 34 of the stamp frame 14.

Figure 6:
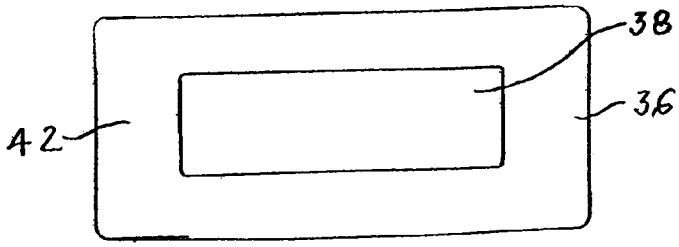
FIG. 6 is a top plan view of the moveable shield.
Figure 7:
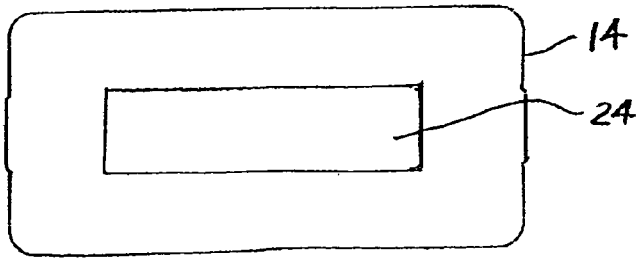
FIG. 7 is a top plan view of the stamp frame.

A moveable shield 36 is dimensioned to be received within the bottom opening 34 of the lower portion 28 of the stamp frame 14. The moveable shield 36 has a shield opening 38 that is aligned with the central passageway 24 in the stamp frame 14. The moveable shield 36 has upstanding walls 40 that have a height sufficient to protrude below the bottom opening 34 when the shield is assembled into the lower portion 28. There is a ledge 42 (see FIG. 6) extending around the circumference of the shield 36. The ledge 36 contacts the lower ends of the spring member 32. In its normal non printing position, the moveable shield 36 is in contact with the surface that is to be imprinted with an image. If a downward force is applied to the handle 20 the ledge 42 pushes upward against the spring member 32 causing the moveable shield 36 to move upward resulting in printing the image as will be more fully described later.

A stamp mount 44 has upper and lower portions 46 and 48 respectively. There is an opening 50 passing through the stamp mount 44. The opening 50 is also in alignment with the central passageway 24 and shield opening 38. At the top of the stamp mount 44 are a pair of flexible latches 52 with barbs or catches 53. There is also a plurality of catch openings 54 where the upper and lower portions join together. To assemble the stamp mount 44 to the stamp frame 14, the upper portion 46 of the stamp mount 44 is inserted through the shield opening 38 and then into the bottom opening 34. The flexible latches 52 flex inwardly to allow the upper portion 46 of the stamp mount 44 to pass through the upper portion 22 of the stamp frame 14. Once the barbs 53 pass over the shoulder 26, the flexible latches 52 spring outwardly to lock the stamp mount 44 to the stamp frame 14. The moveable shield 36 is also retained between stamp mount 44 and the stamp frame 14. The moveable shield is allowed slight vertical movement against the spring member 32. As can be seen all three pieces, the stamp mount 44, the moveable shield 36 and the stamp frame 14 are all held together by means of integrally formed latches and receiving openings without the need for any external fasteners. Oftentimes, the hand stamp 10 is supplied with the frame 14, shield 36 and stamp mount 44 assembled.

Opposite the opening 50 in the stamp mount 44 is an open bottom 56. This is adapted to receive a trim ring 68 that retains an ink cartridge or inkpad 60 and a porous foam stamping member 62. The ink cartridge or inkpad 60 is preferably made of a porous foam material that absorbs and retains a thick printing ink.

Figure 10:
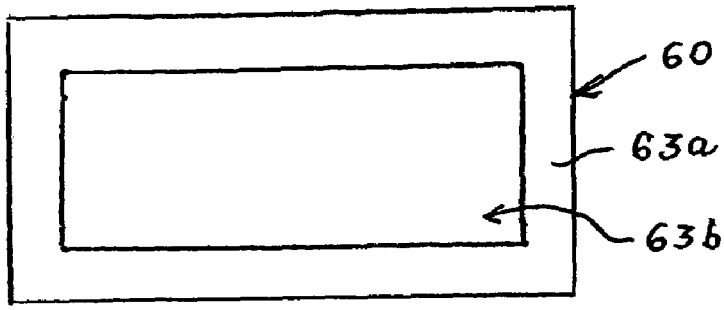
FIG. 10 is a top plan view of the ink cartridge with a center portion removed.
Figure 11:
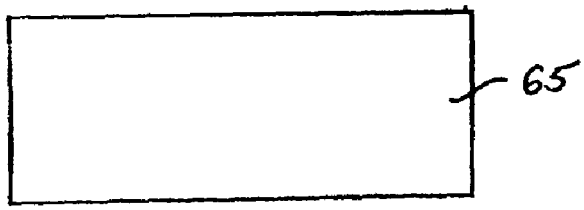
FIG. 11 is a top plan view of the removed center portion.
Figure 12:
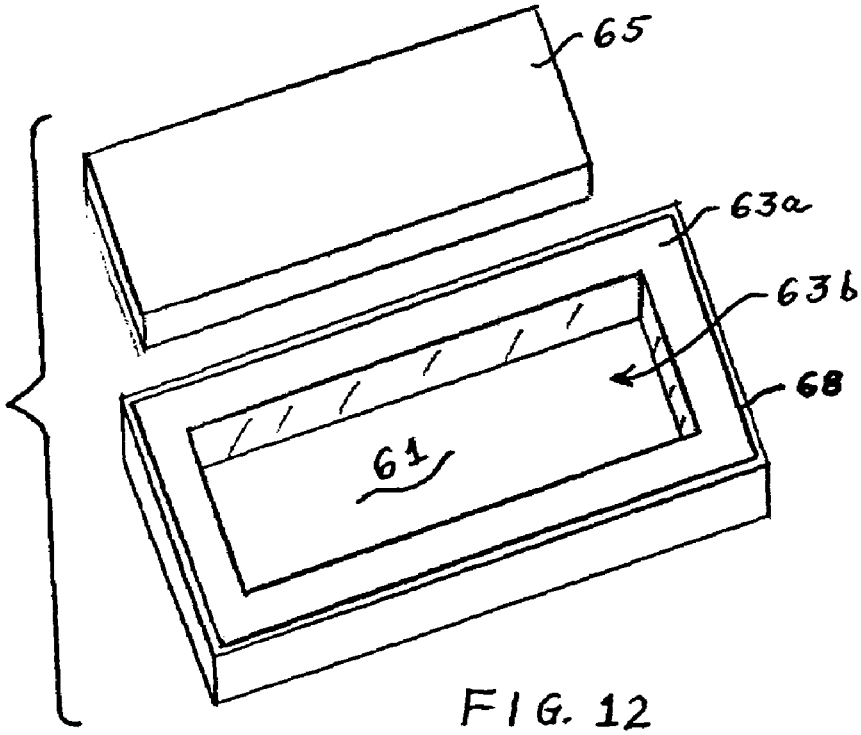
FIG. 12 is a perspective view of the trim ring retaining the foam stamping member and the ink cartridge with the removed portion exploded therefrom.

The ink cartridge or inkpad 60 is more fully illustrated in FIGS. 10–12. The ink cartridge or inkpad 60 has a frame portion 63*a* and a removed central portion 65 creating an opening or well 63*b* within the frame portion 63*a*. The removed central portion 65 is carefully cut from the cartridge 60 so that its walls are smooth so that the central portion 65 can be reinserted into the well 63*b*. The ink cartridge or inkpad 60 is preferably made of a porous foam material that will absorb and retain ink.

The porous foam stamping member 62 has a printing side 64 and a non-printing side 66. The stamping member 62 is prepared for printing an image by placing the image to be reproduced onto a clear plastic film. The image is normally comprised of black and white areas. The clear plastic film with the image on it is applied to the printing side 64 and the stamping member 62 is placed in a sealed light box with the printing side 64 pressed against a clear glass or plastic member. A xenon light is placed in the light box opposite the printing side 64 and energized for a predetermined time. The rays from the light cause a chemical reaction on the foam stamping member wherever there were white image areas. This causes a color change and seals what were the white areas resulting in areas that are non-permeable to the ink. The rays do not penetrate the black image areas and thus no reaction occurs on the printing side 64 of the foam stamping member 62 directly behind the black image areas. These areas remain unsealed and thus ink permeable. There are other methods available to form the image on the foam stamping member. The important point is that there are ink permeable and ink impermeable areas to define the image.

In the preferred embodiment the foam stamping member 62 has a thin foam layer 61 attached to it as seen in FIG. 2. The foam layer 61 is porous and absorbent so that it readily absorbs ink. The foam layer 61 is preferably manufactured from the same material as the cartridge 60. The foam layer 61 is necessary when the frame 63*a* is made of a non porous material. Otherwise the ink will puddle in the well 63*b* and not be absorbed quickly enough into the stamping member 62.

Once the image is formed on the printing side 64, the foam stamping member 62 is placed with the image and printing side 64 down, into the trim ring 68. The trim ring 68 has a plurality of catches or clips 70 disposed about its upper edge. The bottom of the trim ring 68 is substantially open with the exception of a small shelf 72 around the bottom of the trim ring 68. The stamping member 62 is dimensioned to be received snugly within the trim ring 68 with the printing side 64 extending slightly below the bottom of the shelf 72. The frame portion 63*a* of the non-inked ink cartridge 60 is then placed on top of the foam layer 61 of the stamping member 62 as seen in FIG. 12. A quantity of ink sufficient to fill the well 63*b* of the selected color ink is poured into the well or central removed portion 63*b*. The number of impressions that the stamp will make before re-inking is necessary is determined by the amount of ink poured into the well 63*b*. Filling the well 63*b* to the top insures the maximum number of impressions.

In the preferred embodiment the ink saturates the cartridge 60, the foam layer 61 on the foam stamping member 62 and then, over time, the ink will also saturate the stamping member 62. The foam layer 61 assists in the flow of ink from the well 63*b* into the stamping member 62 by providing an additional porous ink storage layer above the stamping member 62. If time was of no concern, the foam layer 61 can be eliminated and the ink in the well 63*b* will eventually soak into the stamping member 62 and the cartridge 60. However, if no foam layer is used, the frame 63*a* will have to be made of a non porous material or the frame 63*a* will leak ink. If no foam layer 61 is used, it may take several hours for the ink to saturate the stamping member 62, compared to about twenty minutes by using the foam layer 61.

The size of the well 63*b* is determined by the amount of ink that is necessary to saturate the stamping member 62 and ink cartridge 60. The dimensions of the well 63*b* are calculated to equal the volume of ink. Thus, when the ink is poured into the well 63*b*, it is poured to the desired level in the well 63*b* and allowed to saturate the ink cartridge 60 and stamping member 62.

Once a portion of the ink has been absorbed by the layer 61 and the frame portion 63*a*, the removed portion 65 from the ink cartridge is then reinserted into the well 63*b*. This serves two functions. First, the removed portion 65 assists in absorbing the ink so that more ink can be stored extending the life of the hand stamp before re-inking. Second, the removed portion 65, when reinserted, adds structural strength to the ink cartridge 60 which supports the stamping member 62. This provides strength to the backside of the stamping member 62 when making impressions so that clear and uniform images are transferred.

Figure 13:
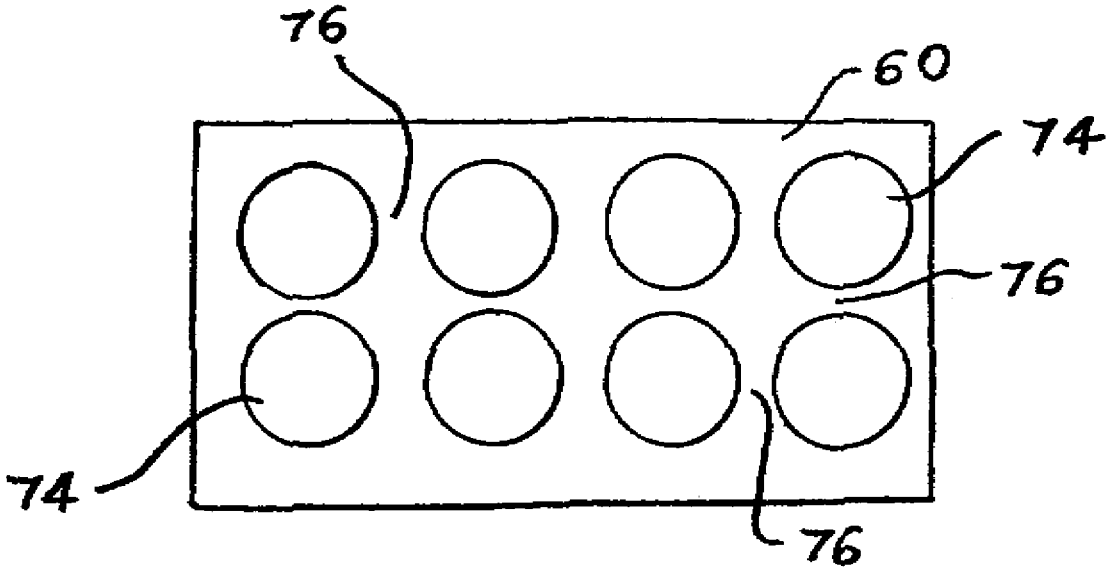
FIG. 13 is a top plan view of an alternative ink cartridge with a plurality of portions removed.

In the alternative embodiment illustrated in FIG. 13, the ink cartridge 60 has a plurality of removed portions or openings 74. These are illustrated as circular cut-out portions in this alternate embodiment, although other various configurations such as squares, rectangles or other geometric shapes will also work. Between adjacent removed portions are structural ribs 76. These ribs 76 provide structural strength to the ink cartridge 60 during stamping so that the portions cut from the cartridge 60 to create the removed portions 74 are not re-inserted prior to using the cartridge 60. The combination of ribs 76 made of the cartridge material and the removed portions 74 store approximately the same amount of ink as the preferred embodiment wherein the removed portion 65 is re-inserted into the well 63*b*. This is due to the fact that the cartridge material absorbs about seven times its weight in ink. Furthermore the structural ribs 76 quickly absorb ink while the remaining ink in the removed portions 74 is absorbed into the foam layer 61. This keeps from flowing into the outer edges of the cartridge and overflowing into the edges of the stamping member 62.

The trim ring 68, with the stamping member 62 and ink cartridge 60 positioned within it, is placed as a unit into the open bottom 56 of the stamp mount 44. The several catches 70 are received in locking relationship in the catch openings 54 in the stamp mount 44. This locks the trim ring 68 into the stamp mount 44. The ink cartridge 60 is in intimate contact with the layer 61 on the stamping member 62. The ink does not flow through the non-permeable areas but flows through the ink permeable areas to print the image. Once a stamping member 62 is saturated with ink, it is always ready for immediate use as long as there is ink in the stamping member 62. When the ink is used up or dries out, the stamping member 62 can be re-inked. The handle cover 12 is removed, and ink can be injected through the opening 50, through the central passageway 24 and into the ink cartridge 60. Alternatively, the ink cartridge 60 can be removed and refilled or replaced.

In an alternative embodiment the ink cartridge 60 is actually made of two different materials. The frame portion 63*a* is made of a non porous material such as cork or plastic. When the well 63*b* is filled with ink, the frame 63*a* retains the ink within the well 63*b* until it saturates the stamping member 62 and the layer 61 (if present). Then the removed portion 65 is inserted into the well 63*b*. The removed portion 65 can be made from an absorbent material such as layer 61 or can be made from a non absorbent material such as cork or plastic. This embodiment will not function as well as the preferred embodiment as it will not absorb ink as quickly nor will it store nearly as much ink as the preferred embodiment. Furthermore, a foam layer 61 is necessary as the frame 63*a* is non porous and will keep the ink within the well 63*b*.

When the user wants to use the stamp 10 to print an image onto an image receiving surface, the user grasps the stamp 10 by the handle cover 12. The stamp is removed from the bottom cover 18. This exposes the stamping member 62. However the moveable shield 36 protrudes below the bottom of the stamp mount 44 which retains the stamping member 62 above the image receiving surface. The user pushes down on the handle cover 12, which in turn forces the stamp frame 14 downward. The moveable shield 36 contacts the image receiving surface which pushes against the moveable shield 36. The moveable shield 36 overcomes the force of the spring member 32 and moves upward into the stamp frame 14. The printing surface 64 contacts the image receiving surface and ink transfers from the ink permeable areas on the stamping member 62 to the image receiving surface.

Thus there has been provided a hand stamp with an improved ink cartridge that fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A hand stamp for transferring an image to an image receiving surface comprising:

a stamp frame;

a stamping member made of a foam material, the stamping member comprising opposite sides and perimeter edges, one side being a printing side for effecting a stamping, and having thereon the image that is transferable to the image receiving surface;

a trim member for receiving and supporting the perimeter edges of the stamping member and for mounting the stamping member in the stamp frame;

an ink cartridge dimensioned to be received in the trim member on top of the side opposite the printing side of the stamping member, the ink cartridge having a portion removed from the ink cartridge leaving a cartridge frame, the cartridge frame receiving a quantity of ink to provide ink to the stamping member, the portion removed from the ink cartridge being re-inserted into the ink cartridge after at least a portion of the quantity of the ink has been at least partially absorbed into the stamping member and frame for providing support to the stamping member during stamping;

whereby any of a variety of colored inks can be poured into the cartridge frame for providing different colored images thereby eliminating the need for storing a variety of pre-inked colored ink cartridges.

2. The hand stamp of claim 1 wherein the trim member is a continuous trim ring with attachment means thereon for attaching the trim ring to the stamp frame.

3. The hand stamp of claim 2 wherein the trim ring comprises a shelf portion extending about the perimeter of the trim ring and an open area within the perimeter for allowing the image to pass through the trim ring.

4. The hand stamp of claim 1 and further comprising a porous foam layer mounted on the top of the stamping member on the side opposite the printing side for increasing the flow rate of ink from the portion removed from the ink cartridge.

5. The hand stamp of claim 4 wherein the ink cartridge and porous foam layer are made of the same material.

6. A hand stamp for transferring an image to an image receiving surface comprising:

a stamp frame;

a stamping member made of a foam material, the stamping member comprising opposite sides and perimeter edges, one side being a printing side for effecting a stamping and having thereon the image that is transferable to the image receiving surface;

a trim member for receiving and supporting the perimeter edges of the stamping member and for mounting the stamping member in the stamp frame;

an ink cartridge dimensioned to be received in the trim member on top of the side opposite the printing side of the stamping member, the ink cartridge having a central open portion forming a cartridge frame, the cartridge frame receiving a quantity of ink to provide ink to the stamping member, a cartridge insert portion substantially the same size as the central open portion and adapted to be inserted into the cartridge frame after at least a portion of the quantity of the ink has been at least partially absorbed into the stamping member for providing support to the stamping member during stamping;

whereby any of a variety of colored inks can be poured into the cartridge frame for providing different colored images thereby eliminating the need for storing a variety of pre-inked colored ink cartridges.

7. The hand stamp of claim 6 and further comprising a porous foam layer mounted on the top of the stamping member on the side opposite the printing side for increasing the flow rate of ink from the central open portion to the stamping member.

8. The hand stamp of claim 6 wherein the cartridge frame is made of a porous foam material that absorbs the ink.

9. The hand stamp of claim 8 wherein the cartridge insert portion is made of a non ink absorbent material.

10. The hand stamp of claim 8 wherein the cartridge insert portion is made of an ink absorbent porous material.

11. The hand stamp of claim 6 wherein the cartridge frame is made of a non ink absorbent material.

12. The hand stamp of claim 9 wherein the cartridge insert portion is made of a non ink absorbent material.

13. The hand stamp of claim 9 wherein the cartridge insert portion is made of an ink absorbent porous material.

14. A trim frame and ink cartridge assembly for a hand stamp having a stamping member formed from a foam material, the stamping member having opposite sides and perimeter edges, one side being a printing side for effecting a stamping, the frame and ink cartridge comprising:

a trim member having a continuous framing wall surrounding the trim member;

means on the trim member for supporting the edges of the stamping member;

an ink cartridge adapted to be placed on the stamping member, the ink cartridge having a removed central portion leaving an uninterrupted ink cartridge frame, the uninterrupted ink cartridge frame receiving a quantity of ink, an ink cartridge insert substantially the same size as the removed central portion and adapted to be inserted into the removed central portion after at least a portion of the quantity of the ink has been at least partially absorbed into the stamping member for providing support to the stamping member during stamping;

whereby any of a variety of colored inks can be poured into the uninterrupted ink cartridge frame for providing different colored stampings thereby eliminating the need for storing a variety of pre-inked colored ink cartridges.

15. The trim frame and ink cartridge assembly of claim 14 and further comprising a porous foam layer adapted to be mounted on the top of the stamping member on the side opposite the printing side for increasing the flow rate of ink from the removed central portion of the ink cartridge to the stamping member.

16. The trim frame and ink cartridge assembly of claim 15 wherein the ink cartridge and porous foam layer are made of the same material.

17. The trim frame and ink cartridge assembly of claim 14 wherein the cartridge frame is made of a non ink absorbent material.

18. The trim frame and ink cartridge assembly of claim 17 wherein the cartridge insert is made of a non ink absorbent material.

19. The trim frame and ink cartridge assembly of claim 14 wherein the cartridge frame is made of ink absorbent material.

20. The trim frame and ink cartridge assembly of claim 19 wherein the cartridge insert is made of ink absorbent material.

* * * * *